US005800119A

United States Patent [19]

Biggadike

[11] Patent Number: 5,800,119

[45] Date of Patent: Sep. 1, 1998

[54] ENVELOPE INVERTER

[76] Inventor: Christopher Stephen Andrew Biggadike, 33 Brown's Road Walthamstow, London, England, E174RN

[21] Appl. No.: 836,957

[22] PCT Filed: Nov. 22, 1995

[86] PCT No.: PCT/GB95/02730

§ 371 Date: May 22, 1997

§ 102(e) Date: May 22, 1997

[87] PCT Pub. No.: WO96/15967

PCT Pub. Date: May 30, 1997

[30] Foreign Application Priority Data

Nov. 23, 1994 [GB] United Kingdom ..... 9423649

[51] Int. Cl.[6] ..... B65H 15/00

[52] U.S. Cl. ..... 414/757; 198/402; 198/406; 271/2; 271/186

[58] Field of Search ..... 271/2, 186; 198/416; 414/757

[56] References Cited

U.S. PATENT DOCUMENTS

| | | | |
|---|---|---|---|
| 1,454,051 | 5/1923 | Heulings | 198/402 X |
| 2,831,564 | 4/1958 | Pavesi | 198/416 X |
| 3,119,327 | 1/1964 | Pidgeon | 271/186 X |
| 3,656,605 | 4/1972 | Gess | 198/402 |
| 4,384,813 | 5/1983 | Smith et al. | 271/186 X |
| 4,884,793 | 12/1989 | Hurst | 271/2 |
| 5,094,441 | 3/1992 | Sebileau | 271/186 |

FOREIGN PATENT DOCUMENTS

| | | |
|---|---|---|
| 964583 | 5/1957 | Germany . |
| 1181721 | 11/1964 | Germany . |
| WO98/12015 | 12/1989 | WIPO . |

*Primary Examiner*—Janice L. Krizek

[57] ABSTRACT

An envelope inverter comprises a conveyor (14) arranged below a surface (2) onto which envelopes (6) are delivered through a slot (4). The surface (2) is arranged such that each envelope (6) is unstable thereon, and tends to rotate about the edge (12) of the surface, striking the conveyor (14), which moves in a direction tending to continue the rotating movement until the envelope (6) comes to rest inverted on the conveyor.

15 Claims, 2 Drawing Sheets

ENVELOPE INVERTER

This invention relates to an envelope inverter apparatus which is applicable to systems for continuously handling paper or envelopes for example in continuous processes which insert paper into an envelope, seal the envelope and subsequently frank the envelope for mailing. The apparatus may also be used to invert other items such as paper, cards or various kinds of documents.

In continuous paper handling systems a problem often arises in that the paper or envelope needs to be presented, for consecutive processes, with a different side facing upwards. For example, standard inserting machines such as PFEs own Automailer 3 requires envelopes to be presented with the flap side uppermost, so that the flap can be held open and material inserted effectively and efficiently. Subsequently the flap is folded down and sealed. In a fully automated mailing system, the envelope must subsequently be presented to a franking machine to apply an appropriate postage stamp. Franking machines traditionally require an envelope to be presented flap side down.

At present this problem is overcome primarily by manual intervention in that the inserter machine stacks the filled envelopes and an operator periodically picks up the stack, turns it over and puts the envelopes, address side up, one by one into the franking machine.

Obviously a fully automated mailing system requires a mechanism for inverting the envelopes.

One known apparatus for inverting envelopes is a rotating carousel with six or eight radially spaced arms which each grip an envelope and carry it around an arcuate path from the output of the inserter machine to the input of the mailing or franking machine, inverting it through 180° to turn it upside down. Such a carousel is extremely space consuming and requires an accurate and complex drive and indexing system to operate. It is therefore expensive and can be unreliable. Also it can only cope with a single size of envelope at any one time.

The present invention aims to provide a space saving, reliable apparatus for inverting pieces of paper or envelopes continuously and reliably and which can handle different sized envelopes.

According to the present invention, there is provided apparatus for inverting envelopes or the like comprising feeding means for feeding the envelopes successively onto a receiving surface, the receiving surface being arranged such that the envelope is unstable thereon and such that a first edge of the envelope tends to rotate downwardly about a line parallel thereto, a conveyor being provided below the receiving surface for receiving the first edge of the envelope and conveying in a direction substantially perpendicular to the first edge so as to continue the rotation of the envelope until the envelope is inverted on the conveyor.

Preferably, the direction of feed of the feeding means is parallel to the first edge of each envelope. Thus, correct positioning of the envelopes is facilitated.

An obstacle may be arranged to be in the path of each envelope on the conveyor for contacting the first edge of the envelope and obstructing forward movement thereof such that the envelope turns about the region of contact with the obstacle until the first edge is substantially parallel to the conveyor direction. The obstacle may have an abutment surface which is parallel to the conveyor direction for abutting the first edge of the envelope. The envelopes can thus be turned through 90°, and positioned consistently so that, for example, they can be fed to a franking machine.

The receiving surface may be arranged in various different ways. For example, it may be substantially horizontal, having an edge which is substantially parallel to the first edge of each envelope. In such a case, the receiving surface may be located such that the first edge of each envelope received thereon overhangs the edge of the surface, and in particular such that the centre of gravity of each envelope overhangs the edge.

In one embodiment, a sheet material may be bent to form a substantially right-angled profile, one of the outer facets of the angle forming the receiving surface. Alternatively, the receiving surface may comprise one facet of a sheet material bent to form a plurality of facets. These may serve to guide the rotation of the envelopes.

In another embodiment the receiving surface is tilted about a line substantially parallel to the first edge of each envelope with respect to the horizontal plane, such that the envelopes tend to slip off the surface.

Preferably, the receiving surface is a smooth metallic surface to encourage the instability of the envelope, or its tendency to tip or slide off the surface. Conveniently, the conveyor comprises a pair of substantially parallel conveyor belts, the obstacle being provided between the belts.

Preferably, the receiving surface is movable in a substantially horizontal plane, in a direction perpendicular to the first edge of each envelope, for accommodating envelopes of different sizes. The distance from the receiving surface to the conveyor is preferably shorter than the distance from the first edge of the envelope to the opposite edge thereof.

In order that the invention may be more readily understood, reference will now be made, by way of example, to the accompanying schematic drawings, in which.

Figure 3A:
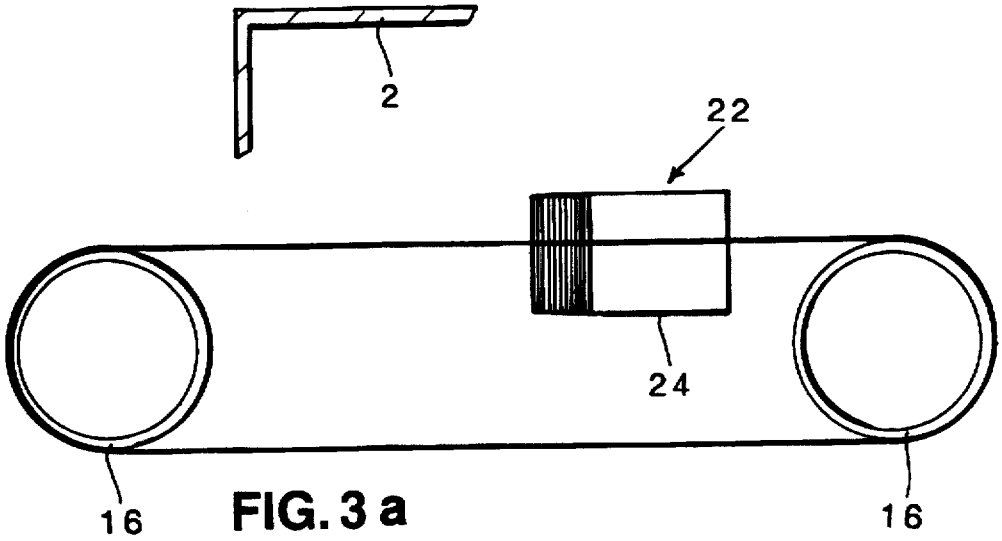

FIG. 3*a* shows a side elevation view of a second embodiment of apparatus according to the invention.

Figure 3B:
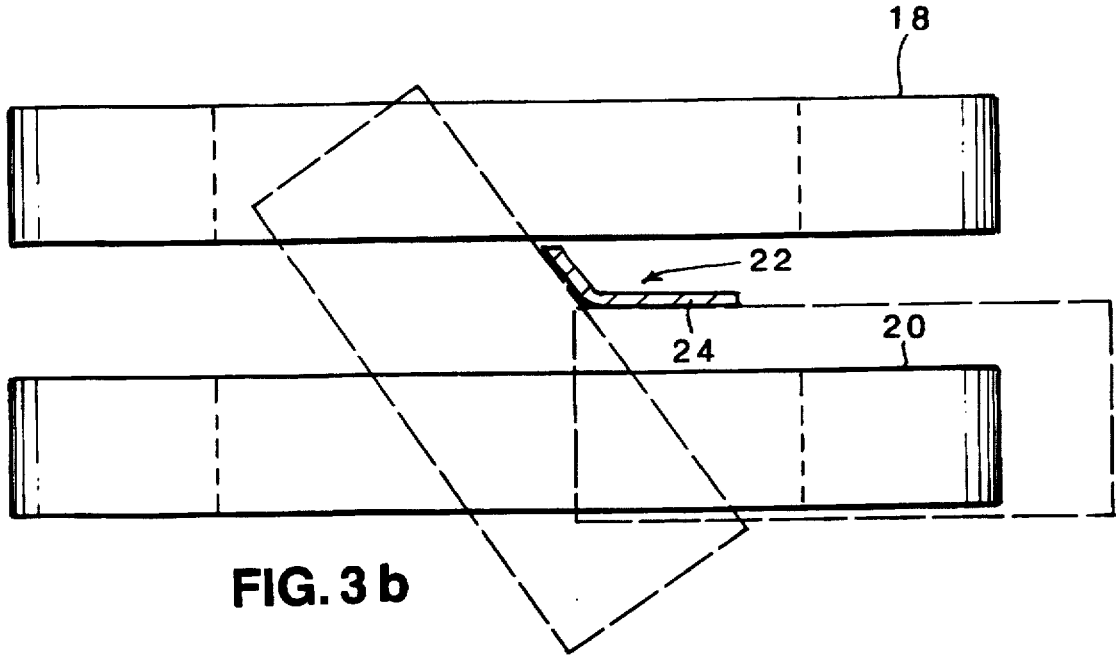

FIG. 3*b* shows a top elevation view of the second embodiment of apparatus according to the invention.

Referring to the Figures, the apparatus includes a receiving surface 2 in the form of one facet of an angled profile. The receiving surface 2 is positioned adjacent the opening 4 of a feeding means (not shown) for envelopes. Envelopes 6 are fed through the opening 4 onto the receiving surface 2, which is positioned such that a first edge 10 of each envelope 6 overhangs the edge 12 of the surface 2, and the centre of gravity of the envelope 6 also overhangs the edge 12 of the surface 2.

Figure 1:
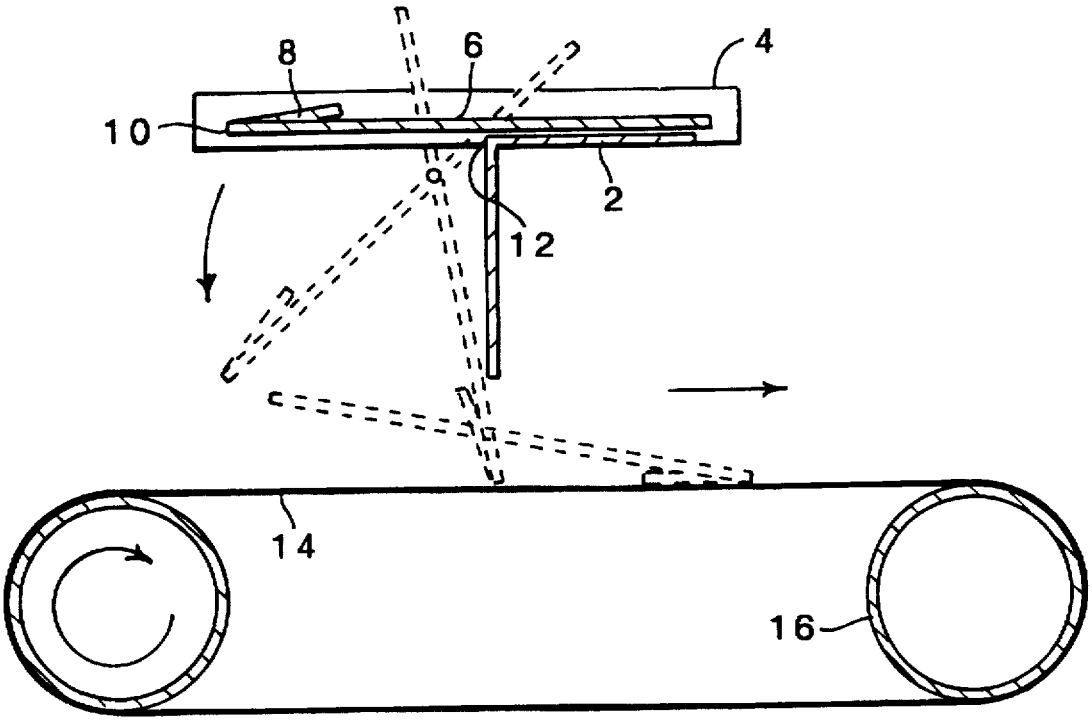
FIG. 1 is a cross-sectioned view of apparatus according to the invention.
Figure 2:
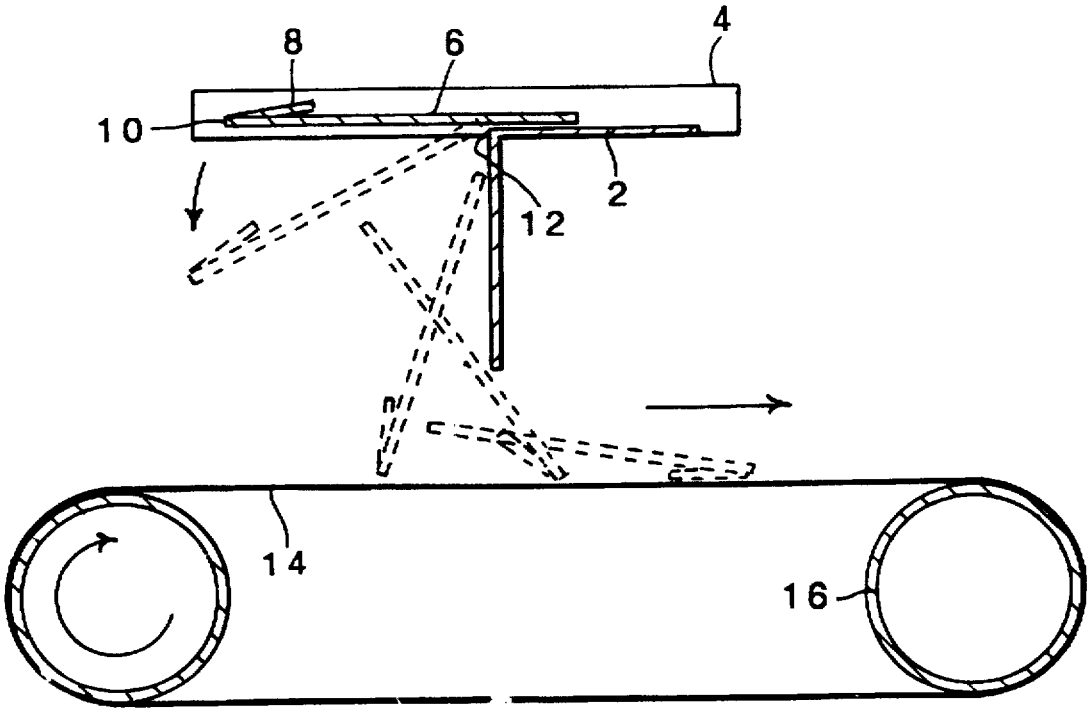
FIG. 2 shows the apparatus of FIG. 1 with an envelope of a different width.

Thus the first edge 10 of the envelope 6 tends to rotate downwardly (as shown by arrows in each Figure) until it contacts a conveyor 14 positioned below the surface 2. The conveyor 14, which may for example be a conveyor belt or a pair of belts 18 and 20 as shown in FIGS. 3*a* and 3*b*, driven by rotating drums 16, moves in a direction which is perpendicular to the first edge and thus tends to continue the rotational movement of the envelope, as shown in broken lines in the Figures, such that the upper surface thereof lands lowermost on the conveyor 14.

Where the envelopes are fed to the surface 2 by the feeding means after having been filled, and having a sealing flap 8 folded, the first edges of each envelope are commonly aligned, regardless of the width of the envelope. In such a case the receiving surface 2 may be positioned such that envelopes of different widths all have their centre of gravity past the edge 12 thereof so as to be unstable (compare FIGS. 1 and 2). Thus the receiving surface 2 may be movable towards or away from the position of the first edge 10 of each envelope, so that different ranges of envelope widths may be accommodated.

If the envelopes are required to be franked after inversion, they may be turned by an obstacle 22 in the path of the conveyor, as is well known in the art. The obstacle may have an abutment surface 24 parallel to the conveyor direction, such that the first edge of each envelope is aligned, and the envelopes can be passed directly to a franking station.

Whilst one embodiment of the invention has been described, it will be appreciated that modifications may be made without departing from the scope of the invention.

For example, the receiving surface may be one facet of a profile having three or more facets. Where the profile has three facets, these may be at about 45° to each other, the first facet forming the receiving surface, and the second and third facets helping to guide the rotation of the envelope. Alternatively the receiving surface may be simple tilted planar surfaces, such that the envelope slides downwardly onto the conveyor.

I claim:

1. Apparatus for inverting envelopes comprising feeding means for feeding the envelopes successively onto a receiving surface, the receiving surface being arranged such that the envelope is unstable thereon and such that a first edge of the envelope tends to rotate downwardly about a line parallel thereto, a conveyor being provided with a moving surface below the receiving surface for receiving the first edge of the envelope and conveying the envelope in a direction substantially perpendicular to the first edge so as to continue the rotation of the envelope until the envelope is inverted on the conveyor.

2. The apparatus of claim 1, in which said feeding means feeds the envelope in a direction parallel to the first edge of each envelope.

3. The apparatus of claim 1, wherein the receiving surface is tilted with respect to a horizontal plane about a line substantially parallel to the first edge of each envelope and the line about which the envelope rotates downwardly.

4. The apparatus of claim 1, in which the receiving surface is a smooth metallic surface.

5. The apparatus of claim 1, in which the receiving surface is movable in a substantially horizontal plane, perpendicular to the first edge of each envelope, for accommodating envelopes of different sizes.

6. The apparatus of claim 1, in which the distance from the receiving surface to the conveyor is shorter than the distance from the first edge of the envelope to the opposite edge thereof.

7. The apparatus of claim 1, comprising an obstacle arranged to be in the path of each envelope on the conveyor for contacting the first edge of the envelope and obstructing forward movement thereof such that the envelope turns about the region of contact with the obstacle until the first edge is substantially parallel to the conveyor direction.

8. The apparatus of claim 7, in which the obstacle has an abutment surface which is parallel to the conveyor direction for abutting the first edge of the envelope.

9. The apparatus of claim 7, in which the conveyor comprises a pair of substantially parallel conveyor belts, the obstacle being provided between the belts.

10. The apparatus of claim 1, in which the receiving surface is substantially horizontal, and has an edge which is substantially parallel to the first edge of each envelope, and forms the line about which the envelope rotates downwardly.

11. The apparatus of claim 10, in which the receiving surface is located such that the first edge of each envelope received thereon overhangs the edge of the surface.

12. The apparatus of claim 10, wherein the receiving surface comprises one facet of a sheet material bent to form a plurality of facets.

13. The apparatus of claim 10, comprising a sheet material bent to form a substantially right-angled profile, one of the outer facets of the angle forming the receiving surface and said edge of said receiving surface being the outer edge formed by the intersection of said outer facets.

14. The apparatus of claim 13, wherein the other one of the outer facets extends from said edge towards the conveyor, so as to engage the envelope and cause the envelope to rotate about its first edge until the envelope is inverted on the conveyor.

15. The apparatus of claim 14, wherein the movement of the first edge of the envelope as it rests on the conveyor, causes engagement of the envelope with the lower edge of the other one of the outer facets so as to cause the envelope to be rotated and come to rest in an inverted position on the conveyor.

* * * * *

UNITED STATES PATENT AND TRADEMARK OFFICE

CERTIFICATE OF CORRECTION

PATENT NO. : 5,800,119

DATED : September 1, 1998

INVENTOR(S) : Christopher Stephen Andrew Biggadike

It is certified that error appears in the above-indentified patent and that said Letters Patent is hereby corrected as shown below:

On the title page,

Insert

Item [73] Assignee: Printed Forms Equipment Limited
Great Britian

Signed and Sealed this

Twenty-ninth Day of December, 1998

*Attest:*

Bruce Lehman

BRUCE LEHMAN

*Attesting Officer*

*Commissioner of Patents and Trademarks*